US005339836A

United States Patent [19]

Lauenstein et al.

[11] Patent Number: 5,339,836

[45] Date of Patent: Aug. 23, 1994

[54] CIGARETTE-MAKING MACHINE WITH TRANSFER DEVICE

[75] Inventors: Michael Lauenstein, Cormondréche; Bernard Tallier, Gorgier, both of Switzerland

[73] Assignee: Fabriques de Tabac Réunies SA, Neuchatel-Serrieres, Switzerland

[21] Appl. No.: 104,806

[22] Filed: Aug. 10, 1993

Related U.S. Application Data

[63] Continuation of Ser. No. 821,167, Jan. 16, 1992, abandoned.

[30] Foreign Application Priority Data

Jan. 31, 1991 [CH] Switzerland ..... 00292/91-9

[51] Int. Cl.[5] ..... A24C 5/18

[52] U.S. Cl. ..... 131/84.1; 131/84.2

[58] Field of Search ..... 131/84.1, 84.2, 84.4, 131/85, 87, 64.1, 64.2

[56] References Cited

U.S. PATENT DOCUMENTS

| | | | |
|---|---|---|---|
| 3,915,176 | 10/1975 | Heitmann et al. . | |
| 4,485,826 | 12/1984 | Holzangel | 131/84.1 X |
| 5,003,996 | 4/1991 | Tallier et al. | 131/84.2 |

FOREIGN PATENT DOCUMENTS

| | | | |
|---|---|---|---|
| 2232892 | 1/1974 | Fed. Rep. of Germany . | |
| 369057 | 6/1963 | Switzerland | 131/84.1 |
| 945838 | 1/1964 | United Kingdom . | |
| 995604 | 6/1965 | United Kingdom . | |
| 2000675 | 1/1979 | United Kingdom . | |

*Primary Examiner*—Jennifer Bahr

*Attorney, Agent, or Firm*—Kevin B. Osborne; James E. Schardt; Charles E. B. Glenn

[57] ABSTRACT

A strip of paper (42) in which the rod of tobacco (31) is to be wrapped runs parallel for a certain distance to a porous band (21) carrying the rod. By applying a certain degree of compression to the rod before it enters a guide groove disposed under a guide finger (45), a round shape can be imparted to the rod of tobacco while reducing the friction of the tobacco against the walls of the groove, thus lessening heating of the tobacco and wear and tear on the groove.

6 Claims, 3 Drawing Sheets

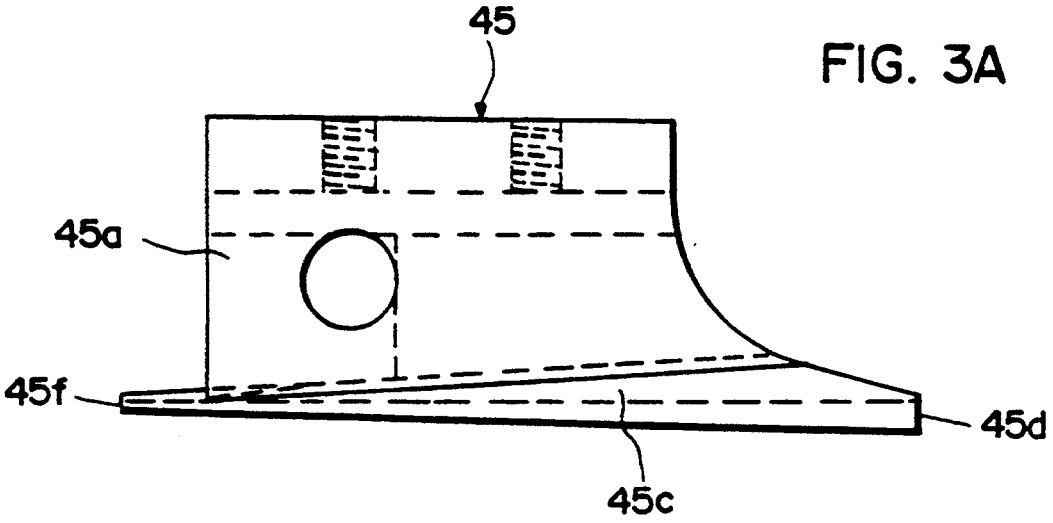
FIG. 3A
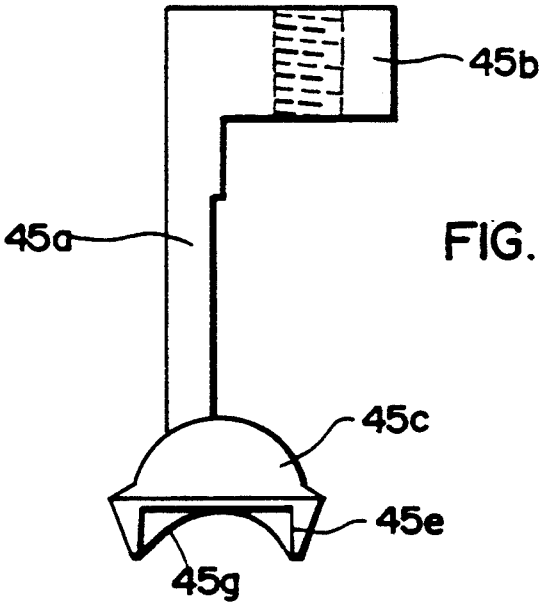
FIG. 3B
FIG. 3C
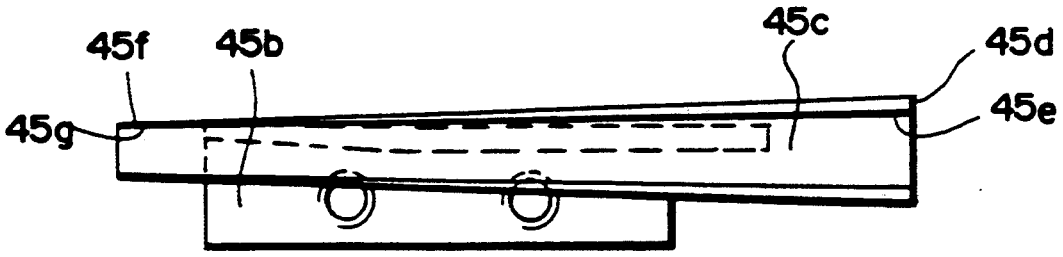

CIGARETTE-MAKING MACHINE WITH TRANSFER DEVICE

This is a continuation of U.S. application Ser. No. 07/821,167, filed Jan. 16, 1992, entitled CIGARETTE-MAKING MACHINE WITH TRANSFER DEVICE, now abandoned.

BACKGROUND OF THE INVENTION

This invention relates to cigarette manufacture, and more particularly to a cigarette-making machine of the type having means for conveying a rod of tobacco made up of a dumping beam (otherwise known as a suction rod conveyor) comprising a porous band moving longitudinally, on the underside of which the rod is formed and moved, being held by suction, as well as means for disposing a strip of paper about the rod of tobacco.

The part of the cigarette-making machine which forms and conveys the tobacco rod by suction on a moving porous band has been disclosed, particularly in commonly assigned U.S. Pat. No. 5,003,996 and in copending, commonly-assigned U.S. Pat. application Ser. No. 07/717,937, filed Jun. 20, 1991, now U.S. Pat. No. 5,168,882. The same applies to the part where the rod is wrapped in a strip of paper to form a continuous round cylinder. The transfer device, which is the part of the machine situated between the two foregoing parts, and which is responsible for the transition or transfer of the rod between the porous band and the strip of paper conveyed by a continuous band disposed opposite the previous one, as well as for shaping the rod of tobacco into a cylinder of circular cross-section, is the part of interest within the scope of the present specification.

According to the prior art, this part of the machine includes a return-pulley for the porous band, usually a driving pulley, of relatively large diameter. Inasmuch as the .dumping beam is under negative pressure with respect to the ambient atmosphere in order to draw the tobacco onto the porous band, a certain air-tightness must be ensured at the end of it, especially at the location where the return-pulley is disposed. For that purpose, it is necessary to provide a mechanical part in the form of a shoe, a concave arcuate portion of which is applied at a short distance from the porous band disposed on the pulley; in order to keep a uniform distance between this shoe and the band, the shoe is adjustably attached to the dumping beam, downstream from the return-pulley.

Slightly upstream from the end of the dumping beam, on the top part of the frame of the machine facing the porous band and beneath the latter, another pulley guides another band carrying the strip of paper which is to surround the rod of tobacco. The strip of paper and the porous band approach one another for a certain distance as they travel, so that the strip of paper starts to drive the rod along at approximately the location where the latter leaves the porous band.

When the rod arrives opposite the axle of the return-pulley of the porous band, it is detached therefrom and enters under the air-tight shoe, guided by a longitudinal groove of semi-square cross-section disposed in the underside of the shoe. When the rod leaves the shoe, it is therefore in a substantially square shape, its top and side surfaces being formed by the sides of the longitudinal guide groove, whereas its bottom surface rests on the strip of paper supported by its conveying band.

After having passed the shoe, the rod of tobacco passes under a guide finger, the underside of which likewise comprises a longitudinal groove and which is adjustably attached to the bed of the machine; the strip of paper is wound about the rod of tobacco along this guide finger, thus carrying the rod along.

As stated above, the rod of tobacco is of substantially square cross-section when it leaves the shoe; after having passed the guide finger and been completely wound in the strip of cigarette paper, it is of circular cross-section, the transition between these two shapes having taken place under the guide finger. The longitudinal groove in the underside of this finger changes gradually from a semi-square cross-section to a semicircular cross-section and thus shapes the upper part of the rod, whereas the round shape of the lower part of the rod is produced when the strip of paper is applied to the rod. For proper shaping of the rod, it is absolutely necessary that the two successive longitudinal guide grooves of the shoe and of the guide finger be flawlessly aligned.

This prior art device comprises numerous drawbacks, particularly that of damaging the tobacco within the rod, for when the rod leaves the porous band and enters the guide groove of the shoe, its top and sides scrape forcefully against this groove; thereafter, when it passes through the guide groove of the guide finger, the rod changes from a square cross-section to a circular cross-section by compression of a significant part of its periphery. The friction of the shreds of tobacco against the shoe and the guide finger brings about extensive wear and tear on these parts, necessitating their frequent replacement. Moreover, because the top of the rod is braked by scraping against the grooves while the bottom part is being moved along by the strip of paper, an effect of longitudinal shear is produced on the rod, damaging the tobacco fibers and creating irregularities of longitudinal tobacco density within the rod, which may go so far as to tear the rod, as well as variations in the distance separating the regions of greater tobacco density intended to constitute the ends of the finished cigarette. This effect is further heightened by the fact that the transition between the advancing of the upper part of the rod by the porous band and the advancing of the lower part of the rod by the strip of paper on its carrier band takes place over a very short distance, even at a single point. Another drawback of the prior art device is that the groove for guiding the top part of the rod is situated on two separate elements, the shoe and the guide finger, each disposed on a separate element of the machine, and that these grooves must be carefully aligned with one another.

SUMMARY OF THE INVENTION

It is an object of this invention to provide an improved cigarette-making machine with transfer device which remedies the aforementioned drawbacks by ensuring better advancing, better guidance, and better shaping of the rod of tobacco.

A further object of the invention is to provide a cigarette-making machine with transfer device which avoids heating of the tobacco.

Still another object of the invention is to provide a cigarette-making machine with transfer device which considerably simplifies the adjustments necessary for correct alignment of the guide elements.

To this end, in the cigarette-making machine according to the present invention, of the type initially mentioned, the improvement comprises a transfer device for the rod of tobacco, disposed at the end of the conveying means and before the means for disposing a strip of paper, and a second band driving the strip of paper, the porous band and the strip of paper being disposed in order to advance the rod of tobacco over a definite portion of the device.

BRIEF DESCRIPTION OF THE DRAWINGS

A preferred embodiment of the invention will now be described in detail with reference to the accompanying drawings, in which:

FIGS. 3A–3C are a front elevation, a side elevation, and a bottom view, respectively, of a guide finger in the preferred embodiment.

DETAILED DESCRIPTION OF THE INVENTION

Figure 1:
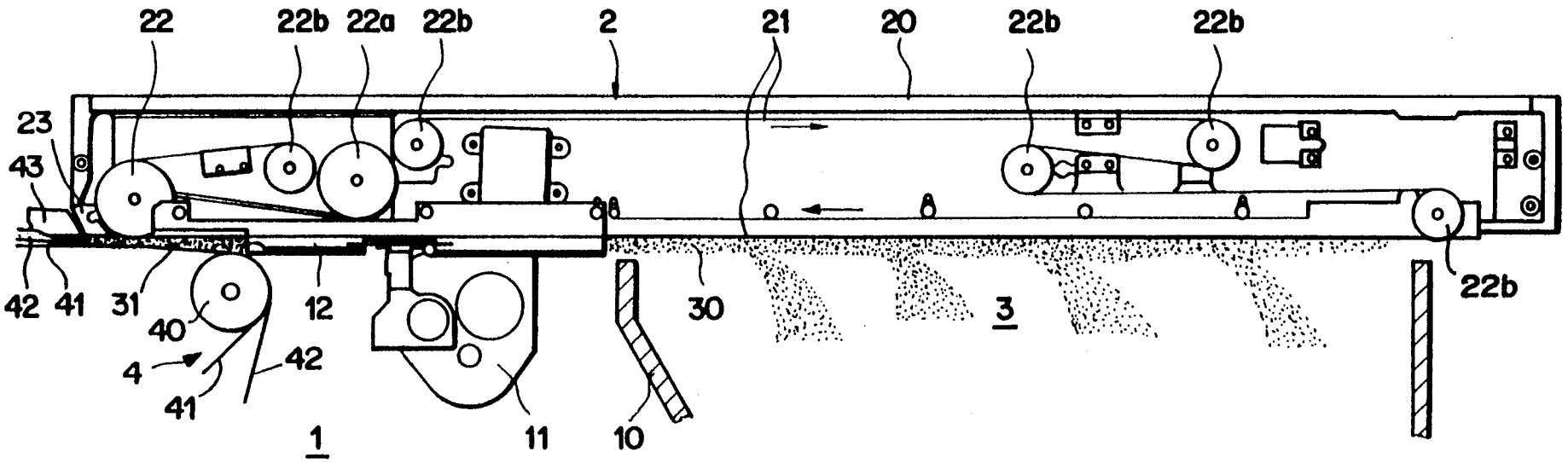
FIG. 1 Prior Art
FIG. 1 is an elevation of a cigarette-making machine on which a prior art transfer device is mounted.

FIG. 1 shows a cigarette-making machine 1 on which a dumping beam 2 according to the prior art is mounted. Machine 1 includes in particular a supply bin 10 for an intermediate stock of tobacco 3 and a compression-trimming device 11. Beam 2 is made up of a metal frame 20 in the general shape of an elongated parallelepiped, the bottom face of which is open so that a moving porous band 21 is accessible for making a rod of tobacco 30. Band 21 is an endless belt driven by pulleys 22 and **22*a* so as to move in the directions indicated by the arrows; pulleys 22*b* serve only as idler pulleys or to keep porous band 21 taut. The means (not shown) for driving pulleys 22 and 22*a*** is conventional.

A suction device (not shown) opens out within metal frame 20 of beam 2 on the upper face of the lower length of porous band 21. Thus, when the suction device is operating and porous band 21 is being driven by pulleys 22 and **22*a*, the tobacco 3 in bin 10 is drawn up through porous band 21 and collects under that band to form a rod 30 which, after passing through compression-trimming device 11, then through lateral guides 12, becomes the rod 31 to be found toward the downstream end of beam 2. At that location, rod 31 is approximately square in cross-section, its top surface being flattened by suction against the underside of porous band 21, its two sides having been shaped against lateral guides 12, and its plane bottom surface stemming from compression trimming device 11**.

Rod 31 is advanced by porous band 21 until it is opposite the axle of pulley 22, where the suction holding it against porous band 21 ceases. A scraper shoe 23 keeps this part of beam 2 air-tight, being adjustably attached thereto; the front portion of shoe 23 is concave and is disposed very close to porous band 21 in order to detach rod 31 from that band. A device for applying cigarette paper 4 is composed of a roller 40 placed slightly upstream from and beneath porous band 21 in order to guide a second band 41 which joins a strip of paper 42 paid out from a stock of such paper (not shown).

The second band 41 and strip of paper 42 are driven at the same longitudinal speed as porous band 21 and rod of tobacco 30. Band 41 and strip of paper 42 are guided in such a way that band 41 approaches porous band 21 at a certain angle, so that strip of paper 42 on band 41 joins the lower part of rod of tobacco 31 approximately at the moment when the rod leaves porous band 21. Rod 31 is therefore advanced simultaneously by both systems for a very short distance, or even just at a single point.

The undersides of shoe 23 and of a guide finger 43, which is adjustably attached to frame 20 of cigarette-making machine 1 and disposed immediately after shoe 23, each include a longitudinal groove. The groove under shoe 23 is of a semi-square shape, whereas that under guide finger 43 changes gradually from a semi-square shape at the front of guide finger 43 to a semicircular shape near the rear of finger 43, where the rod leaves this finger, in order to impart a round shape to the upper part of rod 31 when it passes under finger 43. Strip of paper 42, which is flat when it passes over roller 40, is thereafter guided by a flute (not shown) in order to wind around rod 31 when it passes beneath guide finger 43. When rod 31 leaves finger 43, it is completely surrounded by strip of paper 42, which has thus imparted the round shape to the lower part of the rod.

The transformation of rod of tobacco 31 from a substantially square shape to a round shape thus takes place through compression of the corners of the square. Inasmuch as this compression occurs with friction against a stationary element, it causes heating of and damage to the tobacco fibers. Moreover, since rod 31 is first advanced by porous band 21, then by strip of paper 42, the transition between these two driving means takes place over a very short distance, or even at a single point; this procedure causes the rod of tobacco to undergo discontinuities and irregularities of travel, bringing about uneven filling and sometimes even tearing of the rod. If the rod is torn, cigarette-making machine 1 must be stopped, thus reducing its output.

Another drawback of the prior art machine is that after beam 2 has been opened and reclosed, and before the machine is restarted, the alignment of porous band 21 and shoe 23 relative to guide finger 43 must be checked and possibly corrected. This operation, which is absolutely necessary for obtaining a rod, and hence cigarettes, of proper quality, is complicated and tedious since pulley 22 and shoe 23 are adjusted on beam 2, whereas guide finger 43 is adjusted on the bed of the machine, and these three independent elements must be perfectly aligned.

Figure 2:
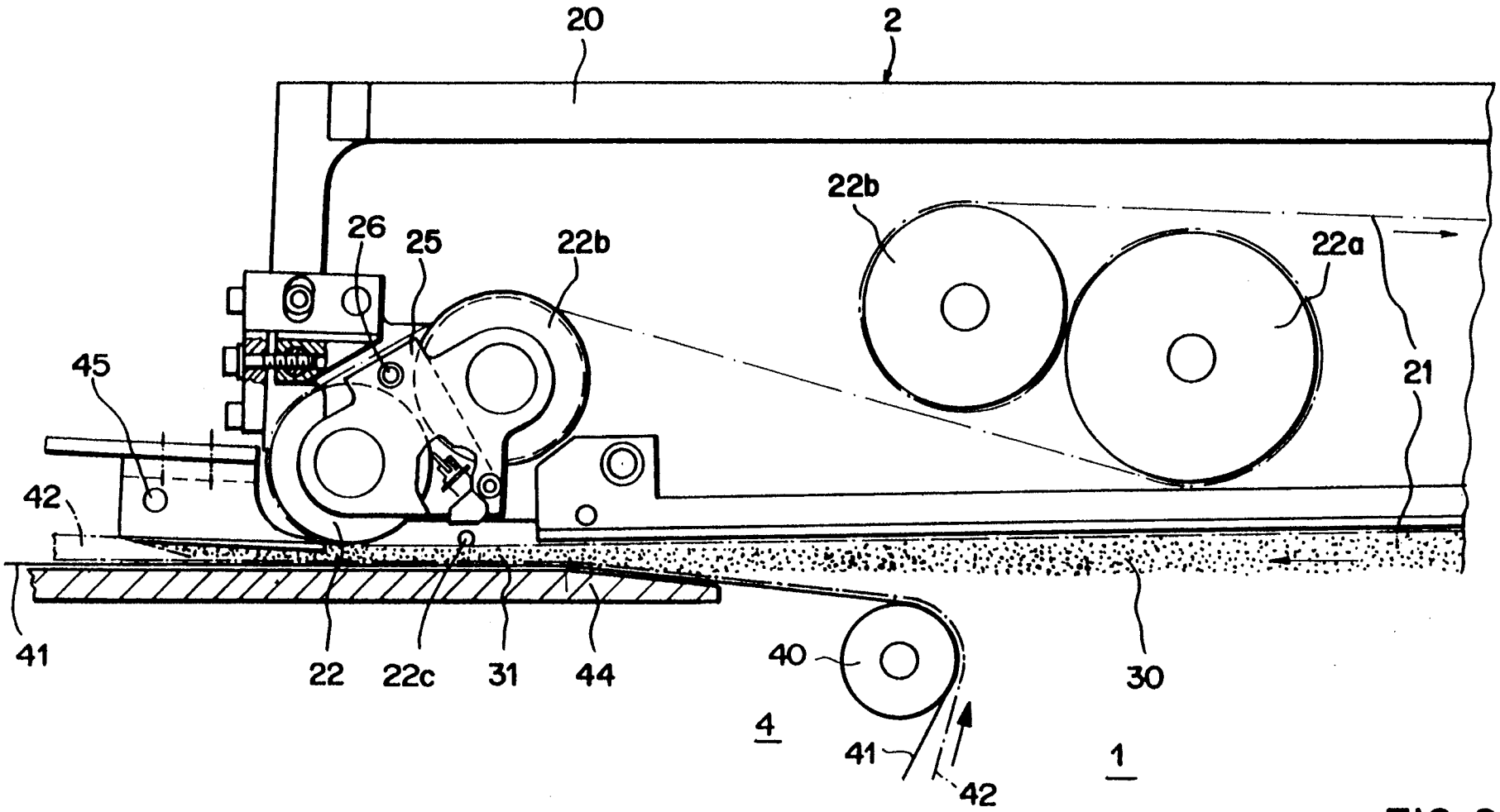
FIG. 2 is an elevation on a larger scale, partially in section, of the downstream portion of a cigarette-making machine on which a transfer device in a preferred embodiment of the invention is mounted.

FIG. 2 shows the downstream portion of dumping beam 2 equipped with the device according to the present invention; the upstream portion, being like that described previously, is not shown. First of all, roller 40 over which the second band 41 passes, transporting strip of paper 42, is shifted upstream; after passing over roller 40, strip of paper 42 is gradually brought into contact with the bottom surface of rod 31, conveyed by a portion of porous band 21 which is slightly inclined relative to a guide plate 44. A fixed support for porous band 21, disposed upstream from pulley 22 and preferably in the form of a ring **22*c* of ceramic material capable of withstanding the abrasion caused by the passage of porous band 21, modifies the path of porous band 21, causing it to move parallel to guide plate 44 along that part of its path between ring 22*c* and the point situated opposite the axle of pulley 22. Thus, rod 31 is gradually squeezed between porous band 21 and band 41 carrying strip of paper 42**. Since these two bands are moving at the same speed, the rod is therefore advanced by these two means simultaneously over a portion of guide plate 44 before the drive by porous band 21 ceases opposite the axle of pulley 22.

This arrangement considerably improves the conveyance of rod of tobacco 31 and appreciably reduces the risk of uneven filling, as well as of tearing of rod 31. The distance separating the two bands 21 and 41 when they are running a parallel planes to one another, i.e., along the portion of the path between fixed ring 22c and the point situated opposite the axle of pulley 22, is such that rod 31 undergoes a certain amount of vertical compression; since this compression takes place between two moving conveyors, no heating of the tobacco takes place.

The diameter of pulley 22 is less than that of the analogous prior art pulley, thus reducing the cross-section to be checked in order to avoid any loss of negative pressure within the dumping beam. Hence the scraper shoe which has hitherto had to be fixed directly to the dumping beam can be eliminated and replaced by a new guide finger 45 performing the functions of the scraper shoe and guide finger of the prior art design.

Guide finger 45 is adjustably attached to the frame of machine 1 in such a way that its transverse position can be adjusted with respect to the rod. The adjustment means are conventional and need not be further described. Guide finger 45 also has a semicircular, concave front end disposed in immediate proximity to porous band 21 on pulley 22. The axle of pulley 22 is supported by a stirrup 25 which also supports the axle of the first idler pulley 22b. By acting upon a pivot attachment 26 of stirrup 25, the latter can be made to swivel slightly and consequently to adjust the longitudinal position of pulley 22 facing guide finger 45.

Adjustment of the relative positions of pulley 22 and guide finger 45 is thus carried out very simply, the longitudinal position being adjusted on pivot attachment 26, while the transverse position is adjusted on guide finger 45. In the inventive device, pulley 22 is no longer a driving pulley, porous band 21 being driven solely by means of pulley 22a.

FIG. 3 shows details of guide finger 45 in the inventive device, FIG. 3A being a front elevation thereof, FIG. 3B a side elevation, and FIG. 3C a bottom view. Finger 45 is seen to be composed of three parts, viz., a vertical support plate 45a, an attachment plate 45b, and a guiding part proper 45c. Vertical plate 45a and attachment plate 45b may either be in one piece or be welded together or joined by any other suitable means in such a way that plate 45b, which is to be fixed to the device for adjusting the transverse position of guide finger 45, is at right angles to the top of vertical plate 45a.

Guiding part 45c is welded to the bottom of vertical plate 45a. As may be seen in FIG. 3B, the underside of part 45c is grooved, with the front end 45d of this groove having the shape of a semi-square 45e and its rearward end 45f having a substantially semicircular cross-section 45g. The groove is seen in FIG. 3C to be semi-frustoconical and in FIG. 3A to have its longitudinal axis slightly offset from the horizontal; this arrangement allows proper shaping of the rod, which must change from an approximately square 20 cross-section when it leaves porous band 21, being slightly compressed as explained above, and passes the end 45d, to a circular cross-section when it leaves the rearward part 45f of the guide finger and is wrapped in the strip of paper. In order to reduce to the greatest extent the friction of the rod against the walls of the groove, causing heating of the tobacco as well as shearing of the rod and wear and tear on the groove, the dimensions of the groove are such that the previously compressed rod regains its volume little by little as it passes under the guide finger and is shaped into a circular cross-section with a minimum of abrasion against the walls of the stationary element formed by the groove of the guide finger. The front portion of vertical plate 45a is blanked in an arcuate shape so that the front portion of guiding part 45c can approach as closely as possible to porous band 21.

The inventive device thus makes it possible to improve considerably the quality of the rod of tobacco, first of all by allowing this rod to be carried along better as it passes from the part of the machine where it is made to the part where it is wrapped in paper, by reducing the friction between the moving rod and the stationary parts, then by facilitating the operations for adjusting the alignment of the parts through which the rod passes, thus improving the quality of the tobacco making up the rod, its filling, and reducing the risk of tearing the rod. The inventive device thus contributes to improving the output of the cigarette-making machine by lessening the risk of malformation of the rod and by cutting down on frictional wear and tear on the parts.

What is claimed is:

1. A cigarette-making machine of the type having:

(1) conveying means for a rod of tobacco, said conveying means having:

(a) a suction rod conveyor including suction means and a porous first band adapted to move longitudinally, the rod of tobacco being formed with a substantially rectangular cross section and being held against the underside of said first band by said suction means for formation and advancing thereby; and (b) means for advancing the rod of tobacco beyond said suction rod conveyor; and (2) means for disposing a strip of paper about the rod of tobacco, including means for imparting a substantially circular cross section to the rod, said cross section having a diameter; wherein the improvement comprises:

said means for imparting a substantially circular cross section to the rod comprising a transfer device for transferring the rod of tobacco, said transfer device being disposed along a predetermined initial portion opposite said porous first band at the beginning of said means for disposing a strip of paper; and said means for advancing the rod of tobacco beyond said suction rod conveyor comprising a second band for driving the strip of paper, said porous first band and the strip of paper being arranged to advance the rod of tobacco over the predetermined initial portion of said transfer device; and said means for imparting a substantially circular cross section to the rod imparting said substantially circular cross section to the rod only after the rod is out of contact with said porous first band, said porous first band and said second band being disposed in an initial inclined relationship such that the paper strip is gradually brought into contact with the rod and then being disposed in parallel planes with the rod between them until the rod is out of contact with said porous first band.

2. The cigarette-making machine of claim 1 wherein:

said suction means accumulates the rod of tobacco held against the underside of said porous first band to a depth; and said porous first band and said second band are disposed in said parallel planes over said predetermined initial portion and are spaced by a distance less than the depth for slightly compressing the rod of tobacco prior to formation of the circular cross section.

3. The cigarette-making machine of claim 2, wherein said suction rod conveyor further comprises an idler wheel associated with said first band and disposed at the downstream end of said suction rod conveyor, and adjustment means including a horizontal pivot attachment secured to said suction rod conveyor and a stirrup piece pivotingly mounted on said pivot attachment for adjusting the longitudinal position of said idler wheel.

4. The cigarette-making machine of claim 1, wherein said transfer device comprises a single mechanical part.

5. The cigarette-making machine of claim 4, wherein said single mechanical part includes an underside having a longitudinal groove, the cross-section of said groove passing continuously from a semi-square shape to a substantially semicircular shape.

6. The cigarette-making machine of claim 5, wherein said groove includes walls of semi-frustoconical shape.

* * * * *